United States Patent [19]

Iimori et al.

[11] Patent Number: 4,790,777

[45] Date of Patent: Dec. 13, 1988

[54] CONNECTOR HOUSING

[75] Inventors: Isao Iimori, Kunitachi; Kazumi Otsubo, Utsunomiya, both of Japan

[73] Assignees: Japan Aviation Electronics Industry Limited; Honda Giken Kogyo Kabushiki Kaisha, both of Tokyo, Japan

[21] Appl. No.: 97,985

[22] Filed: Sep. 18, 1987

[30] Foreign Application Priority Data

Sep. 24, 1986 [JP] Japan ..... 61-145930

[51] Int. Cl.[4] ..... H01R 13/432

[52] U.S. Cl. ..... 439/744

[58] Field of Search ..... 439/492, 499, 744, 746, 439/747

[56] References Cited

U.S. PATENT DOCUMENTS

| | | | |
|---|---|---|---|
| 3,699,502 | 10/1972 | Carter | 439/499 |
| 3,789,343 | 1/1974 | Hirokawa et al. | 439/746 |
| 3,966,295 | 6/1976 | Hyland et al. | 439/746 |

*Primary Examiner*—Joseph H. McGlynn

*Attorney, Agent, or Firm*—Pollock, Vande Sande and Priddy

[57] ABSTRACT

A connector housing composed of a block of an insulating material wherein a plurality of contact receiving holes penetrating from the front surface to the rear surface of said block are formed in at least one row and a slit is formed in the rear surface of the block to communicate said connector receiving holes with one another, whereby the connector housing can be used in common for a connector for wire connection and a connector for FFC connection.

3 Claims, 4 Drawing Sheets

CONNECTOR HOUSING

BACKGROUND OF THE INVENTION

This invention relates to a connector housing which can be utilized for a connector employed in such as an automobile.

Conventionally, the electric wirings for an automobile have been mainly the power line wirings for lights, starting motor, wiper motor, power window motors, defroster, horn and the like. For these wirings, round conductor wires for power supply have been used, and as a connector for connecting wires, the connector for power wires (hereinafter referred to as a wire connector) has been used.

Recently, electronic control devices for keeping the driving of an engine at its optimum conditions and various sensors such as a temperature sensor, a pressure sensor, a gas sensor, a vibration sensor, an optical sensor and the like are employed for the car. Flexible flat cable (abbreviated as FFC) is preferably used as the electrical conductors for transmitting signals detected by various sensors to the controllers in view of making the volume occupied by the wirings smaller. Therefore, recent cars employ both of the connectors for power wires and the connectors for FFC.

As the connector for power wires, an example is shown in U.S. Pat. Nos. 4,607,903 and 4,674,814 by HOSHINO et al. The connector for FFC is quite different from the wire connector as shown for example in U.S. Pat. No. 3,084,302 by BRAEUTIGAM, wherein flat conductors at one end portion of a sheet cable are exposed, and the end portion is lapped with a reinforcing member for attaching to the connector.

Since the connectors for power wires and those for FFC are respectively made, two kinds of metallic molds are necessary for forming connector housings, and therefor the cost for manufacturing molds is high.

Conventional intermingled use of the connectors for the power wire connections and the connectors for FFC cables in each car makes the number of connectors larger and the volume occupied by connectors bigger.

SUMMARY OF THE INVENTION

An object of the present invention is to provide a single connector housing which can be used for either a connector for the power wire connection or a connector for FFC connection.

Another object is to provide a connector housing which accommodates both a connector portion for power wire connection and a connector portion for FFC connection in the same housing.

The connector housing according to the present invention comprises:

(a) A plural number of contact receiving holes passing between front and rear surfaces of an insulating block with openings of the holes arranged in at least one line on each of the front and rear surfaces of the block.

(b) An FFC insertion slit formed for communicating respective contact receiving holes with one another at the openings thereof on the side of the rear surface from which are led out the conductors.

According to the connector housing of the present invention, each of the contact receiving holes is allowed to receive therein either a contact for power wire connection or a contact for FFC connection.

Accordingly, a connector for power wire connection can be readily formed by mounting the contacts for the power wire connections in the connector housing according to the present invention.

In the connector housing according to the present invention, since a slit is formed in the rear surface of the connector housing to communicate the contact receiving holes with one another, an end portion of the FFC can be inserted in this slit.

Therefore, the contacts connected to the FFC can be mounted in the contact receiving holes, forming the connector for FFC connection.

In the case where the contact receiving holes are formed in plural rows, each row of the contact receiving holes can be used for either a power wire connection or FFC conductor connection. Thus, in one connector housing the wire connections and the FFC conductor connections can coexist.

DETAILED DESCRIPTION OF THE PREFERRED EMBODIMENTS

Figure 1:
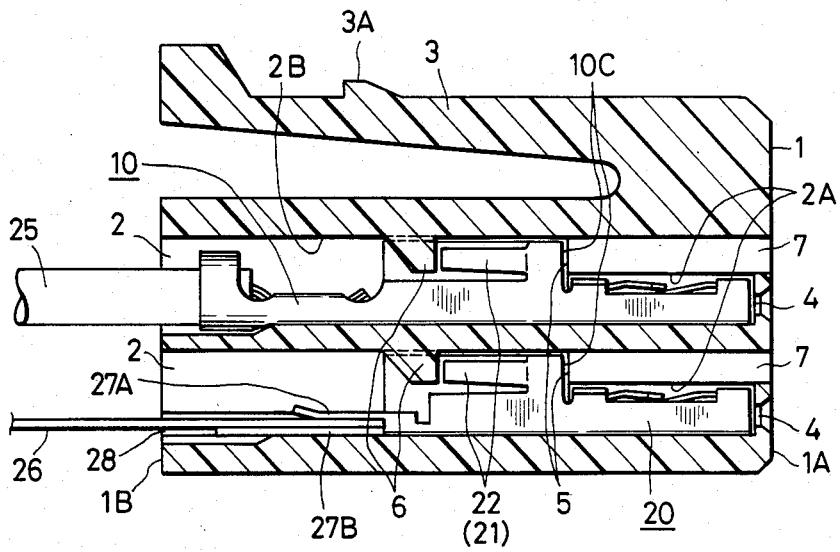
FIG. 1 is a cross sectional view showing an embodiment of a connector housing of the present invention.

An embodiment of the present invention is shown in FIGS. 1-7. Numeral 1 shows a connector housing according to the present invention.

The connector housing according to the present invention s formed in a single body by molding an insulating resin material. Its shape is roughly a square block. A plurality of contact receiving holes 2 are formed to penetrate through the block between a front surface 1A and a rear surface 1B. In the embodiment, on the front surface and the rear surface, three contact receiving holes 2 are provided in each of two rows as seen in the front and rear surfaces shown in FIGS. 4 and 5.

The connector housing 1 of the embodiment shown in the Figures is a male connector housing. The male connector housing 1 will be inserted into an opening of a female connector housing as shown for example in FIG. 2 of U.S. Pat. No. 4,607,903. Through this insertion male contacts projected from the female connector will be inserted into contacts 10 and 20 mounted in the contact receiving holes 2, thereby achieving electrical connections of the connector. Numeral 3 is a locking piece for preventing the male connector housing 1 from being pulled out of the female connector housing when a projection 3A is in engagement with a concavity of the mate in the state of coupling with said female connector.

Each of the contact receiving holes 2 has in the front surface an insertion hole 4, into which a corresponding one of the mate contacts (not shown) is inserted. All of the contact receiving holes 2 are in the same form, with front half portions 2A each being formed as a hole having a low ceiling, and rear half portions 2B being in the form of a hole having a higher ceiling. A step portion 5 is defined by the difference in the height of the high and low ceilings of each contact receiving hole 2. A projection 6 is formed on the surface of the ceiling of the rear half portion 2B. The contacts 10 and 20 can be fixedly mounted between the projections 6 and the step portions 5.

Numeral 7 indicates holes formed along the front half portions 2A of the respective contact receiving holes 2. These holes 7 are left open after pulling out molds used for molding the projections 6 integrally with the molding of the connector housing. Each of these holes 7 can be used as a guide path for inserting thereinto a rod (not shown) to expand lances 21 and 22, whereby engagement between the lances 21, 22 and the projection 6 can be undone to remove the contacts 10, 20 from the contact receiving hole 2.

Figure 2:
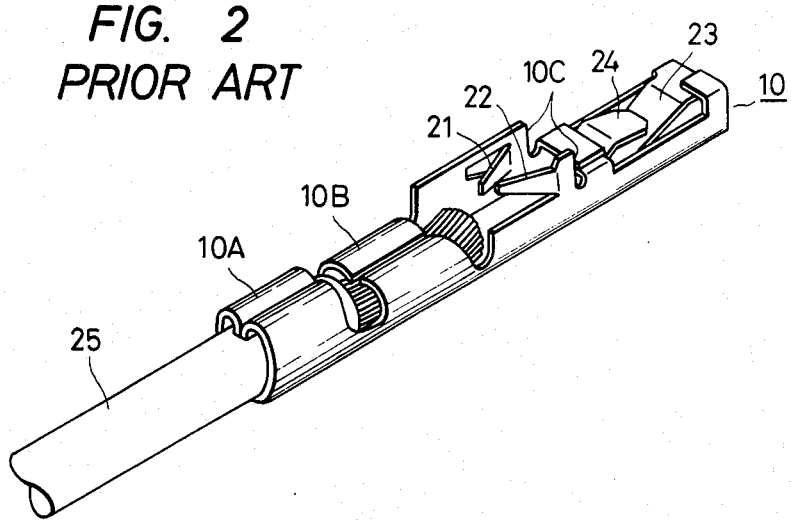
FIG. 2 PRIOR ART
FIG. 2 is an oblique view showing a conventional contact for the power wire connection.

As contacts, both the contacts 10 for power wire connection and the contacts 20 for FFC connection may be prepared. Both the contact 10 for connecting the power wire and the contact 20 for FFC connection are provided with the same structure at portions where these contacts engage with the connector housing 1. Each contact 10 for the power line connection is almost the same as the conventional contact shown, for example, in FIG. 13 of U.S. Pat. No. 4,607,903. As shown in FIG. 2, the contact 10 comprises a wire crimp 10A and a core wire connecting portion 10B at the rear end side of the contact 10, a pair of lances 21 and 22 cut and bent laterally from the surfaces of the side walls, step portions 10C formed as front end edges of the side walls forming lances 21 and 22, and a resilient contact piece 23 provided at the front end portion of the contact 10.

In the embodiment, a structure is shown wherein the resilient force of the contact piece 23 is reinforced by a reinforcing piece 24 which is folded over the contact piece 23. A wire 25 is clamped to the rear end of the contact for the wire connection 10 with the wire crimp 10A and the core wire connecting portion 10B.

Figure 3:
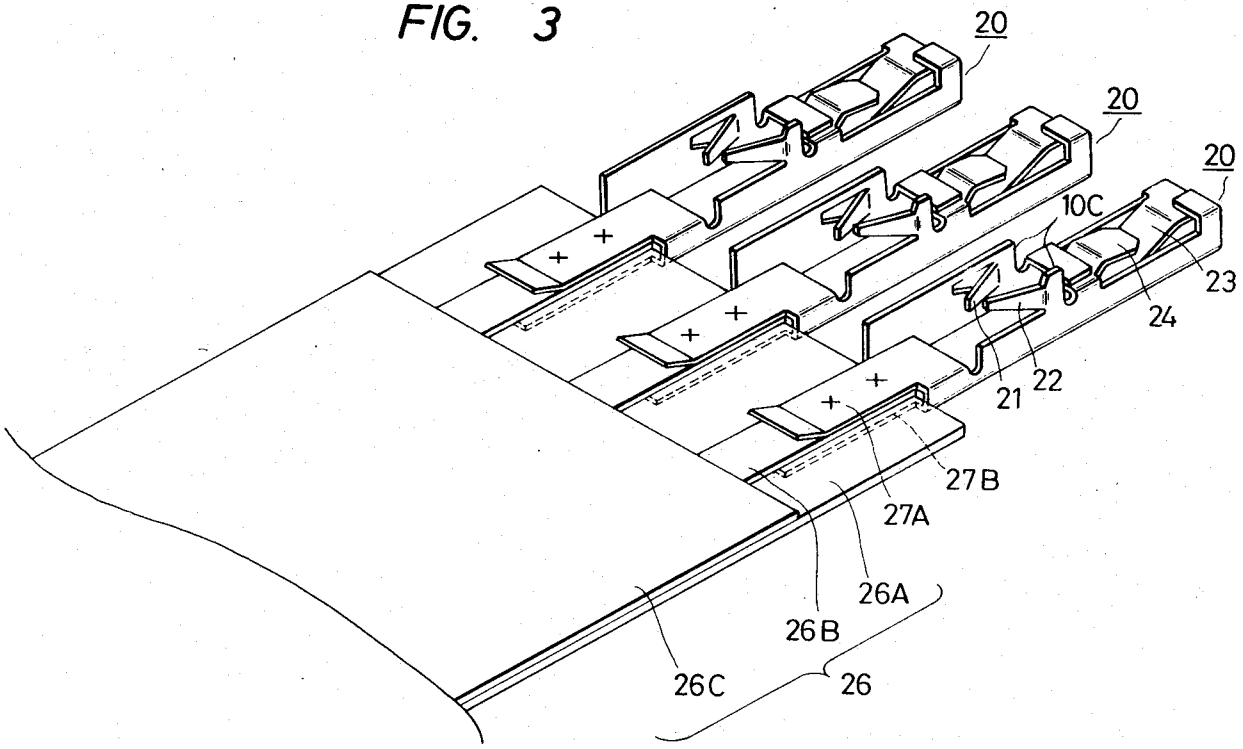
FIG. 3 is an oblique view depicting contacts connected to FFC which can be attached to the connector housing according to the present invention.
Figure 4:
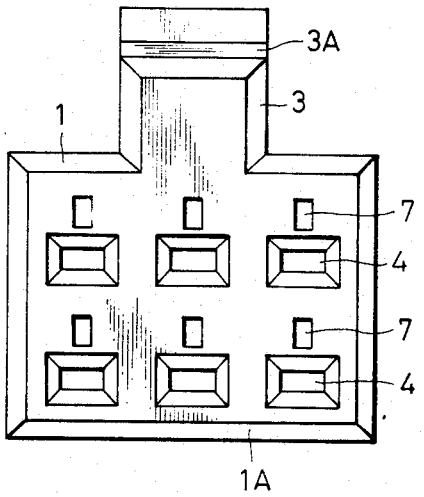
FIG. 4 is a front view of the connector housing according to the present invention.

As shown in FIG. 3, the front half portion of each contact 20 for FFC connection is provided with a resilient contact piece 23, reinforcing piece 24, lances 21 and 22 and step portions 10C. The engagement of the contact 20 to the connector housing 1 is of the same structure as for the contact for wire connection 10. The unique structure of the contact 20 for FFC connection exists in connecting portion to FFC 26 provided at the rear half portion. The FFC connecting portion comprises a connecting piece 27A formed by bending a rear portion of the side wall over the bottom surface of the contact 20 to extend rearward and a contact piece 27B extending backwardly from the bottom surface of the contact in opposing relation to the contact piece 27A.

FFC 26 is formed such that on one surface of a flexible sheet 26A of resin material, foil conductors 26B are formed, which in turn are covered with a film of resin material 26C. For connection of contacts 20 to FFC 26, an end portion of the film 26C is peeled off to expose end portions of the foil conductors 26B, the exposed portions of the foil conductors 26B on the sheet 26A are sandwiched between the contact pieces 27A and 27B led out from the contacts 20 and spot-welded at the points marked X in FIG. 3, and then the contacts 20 are mounted into the end portion of FFC.

The contacts 10 and 20 connected to the wires 25 and FFC 26 are inserted from the rear end surface 1B of the connector housing 1. As the contacts 10 and 20 are inserted from the rear openings of the contact receiving holes 2, each of the projections 6 comes between the lances 21 and 22, flexes them laterally outwardly, and then passes therethrough. After passing by the projection 6, the lances 21 and 22 return to their original postures due to their resilience. Thereafter, the rear ends of the lances 21 and 22 engage with the projection 6, thereby preventing the contacts 10 and 20 from coming off backwardly. The step portions 10C of the contacts 10 and 20 abut against the step portions 5 formed in the respective contact receiving holes 2, thus preventing the contacts 10 and 20 from moving further in a forward direction.

Figure 6:
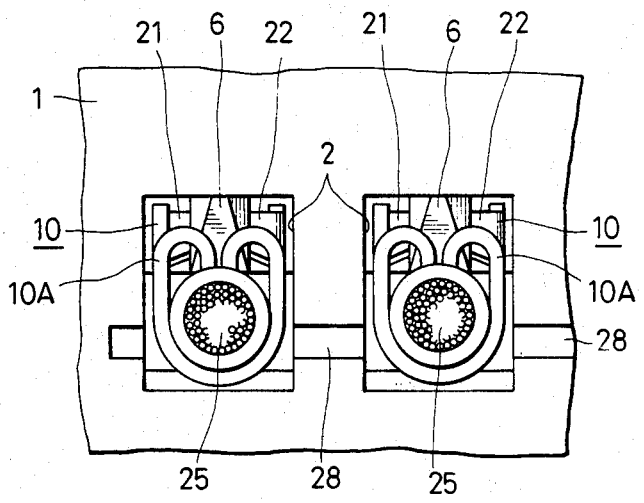
FIG. 6 is an enlarged rear view showing a state in which contacts for power wires are received in the connector housing.
Figure 7:
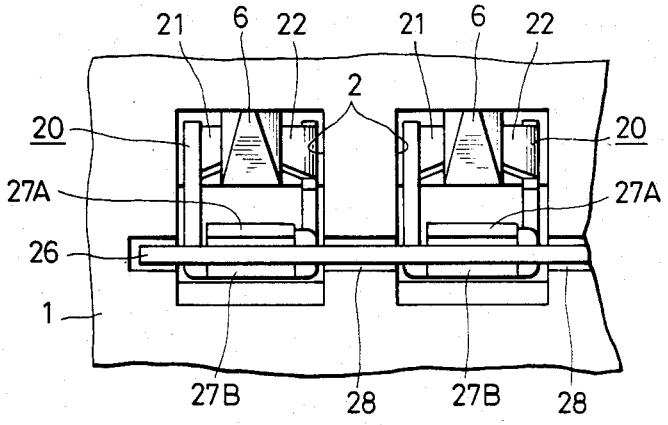
FIG. 7 is an enlarged rear view showing a state in which contacts for FFC are received in the connector housing according to the present invention.

As described above, the contacts 10 and 20 are mounted in the contact receiving holes 2 of the connector housing 1. FIGS. 6 and 7 are partial rear views showing the state where the contacts 10 for wire connection are mounted in the housing 1 and the state where the contacts 20 for FFC connection are mounted in the housing 1, respectively.

Figure 5:
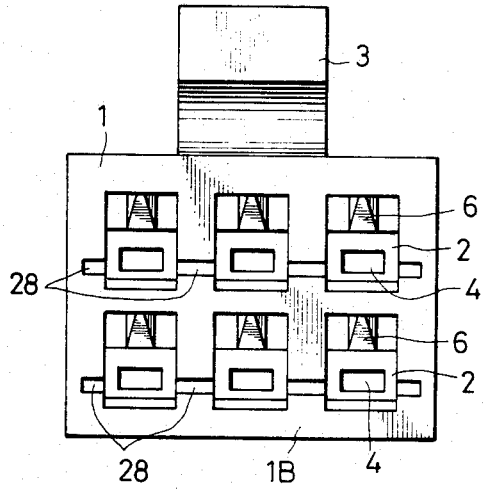
FIG. 5 is a rear view of the connector housing according to the present invention.

The present invention features a structure in which a slit 28 is formed in the rear surface of the connector housing 1 to communicate the contact receiving holes 2 in the same row with one another. A slit 28 is formed for each row of the contact receiving holes 2, as shown in FIG. 5. The depth of the slit 28 is such that the entire portion of the FFC 26 shown in FIG. 3 where the sheet 26C has been removed, can be inserted.

According to this invention, the formation of slit 28 in the rear surface 1B across all of the contact receiving holes 2 in each row allows the contacts 20 on the FFC 26 to be mounted in the contact receiving holes 2 on either of the upper and lower rows. In the embodiment shown in FIG. 1, the contacts 10 for wire connection are mounted in the upper row, and the contacts 20 for FFC connection are mounted in the lower row.

As described above, according to the present invention, the arrangement for engagement between the contacts for wire connection 10 and the connector housing 1 is made the same as the arrangement for engagement between the contacts for FFC connection 20 and the connector housing 1. Therefore, either the contacts for wire connection 10 or the contacts for FFC connection can be attached to any of the contact receiving holes 2.

Further, since the slit 28 is formed in the rear surface 1B of the connector housing 1 across all the contact receiving holes 2 in such row, the contacts 20 which have been attached to the FFC 26 can be mounted into any row of the contact receiving holes 2.

As the embodiment described above, the arrangement of the contact receiving holes 2 can be made in two rows, one for the connector for wire connection, the other for the connector for FFC connection. Accordingly, the connector for wire connection and the connector for FFC connection can coexist in one connector housing. As a result of this, connectors for wire connection and connectors for FFC connection need not be provided individually. Thus, the volume to be occupied by connectors can be made smaller.

Further, since the same connector housing can be used in common for the connector for wire connection and the connector for FFC connection, a metallic mold for molding the connector housing need not be prepared for the two types of connection. Accordingly, the cost of the metallic mold for the connector housing can be made lower.

In the above, though the case where three contact receiving holes 2 are formed in a row has been described, the number of the contact receiving holes 2 in one row is not limited to such an arrangement. Also, the foregoing case employs an arrangement wherein the contact receiving holes 2 are in two rows; however, it will be easily understood that there is no limit to the number of the rows.

What is claimed is:

1. A connector housing formed of a block of an insulating material, comprising:

a plurality of elongated contact receiving holes extending between front and rear surfaces of said block, said contact receiving holes having openings arranged in at least two rows in parallel to each other in each of said front and rear surfaces of said block, each of said contact receiving holes comprising a front half portion with a low ceiling and a rear half portion with a higher ceiling, thereby defining a step portion which is oriented at substantially a right angle to the longitudinal direction of each hole at an intermediate portion of each of said contact receiving holes:

a plurality of projections provided on the respective ceilings of said rear half portions of said contact receiving holes;

a slit formed in said rear surface of said block to communicate respective ones of said contact receiving holes with one another in each of said rows; and a plurality of guide holes formed separately from said contact receiving holes in said front surface of said block to reach corresponding ones of said projections, respectively.

2. A connector housing according to claim 1 wherein each said slit extends beyond both extremities of the row of said contact receiving holes with which said slit is associated.

3. A connector housing according to claim 1, wherein contacts for FFC connection are mounted in at least one row of said contact receiving holes, each of said FFC contacts having engaging means for engaging, at an intermediate portion thereof, with corresponding one of said contact receiving holes and two plate like contact pieces extending backwardly in parallel to each other at the rear of said engaging means.

* * * * *